US007204375B2

(12) United States Patent
Paiste et al.

(10) Patent No.: US 7,204,375 B2
(45) Date of Patent: Apr. 17, 2007

(54) DISPLAY ARM FOR CYMBAL

(75) Inventors: Erik Paiste, Yorba Linda, CA (US); Steve Ziolkowski, La Verne, CA (US)

(73) Assignee: Paiste America, Inc., Brea, CA (US)

( * ) Notice: Subject to any disclaimer, the term of this patent is extended or adjusted under 35 U.S.C. 154(b) by 411 days.

(21) Appl. No.: 10/883,000

(22) Filed: Jun. 30, 2004

(65) Prior Publication Data

US 2005/0029208 A1 Feb. 10, 2005

Related U.S. Application Data

(63) Continuation-in-part of application No. 10/050,899, filed on Jan. 16, 2002, now abandoned.

(60) Provisional application No. 60/261,992, filed on Jan. 16, 2001.

(51) Int. Cl.
*A47F 7/00* (2006.01)
*A47F 5/08* (2006.01)

(52) U.S. Cl. ..... 211/85.6; 211/94.01

(58) Field of Classification Search ..... 211/85.6, 211/94.01, 85, 59.2, 87.01, 32, 96, 59.1; 84/327, 281, 387 A; 248/276.1–441.1, 461
See application file for complete search history.

(56) References Cited

U.S. PATENT DOCUMENTS

| | | | | |
|---|---|---|---|---|
| 3,596,866 | A | | 8/1971 | Baker |
| 3,677,415 | A | | 7/1972 | Radek |
| 3,985,324 | A | | 10/1976 | Larson |
| 4,047,684 | A | | 9/1977 | Kobayashi |
| 4,182,505 | A | | 1/1980 | Cobin |
| 4,441,619 | A | | 4/1984 | Gibitz |
| 4,452,360 | A | | 6/1984 | Barnes |
| 4,516,681 | A | | 5/1985 | Jahel |
| 4,569,498 | A | | 2/1986 | Ermanski |
| 4,614,452 | A | | 9/1986 | Wang |
| 4,635,801 | A | * | 1/1987 | Oren ..... 211/70.6 |
| 4,666,110 | A | | 5/1987 | Prouty |
| 4,690,285 | A | | 9/1987 | Stone |
| 4,781,355 | A | | 11/1988 | Jeantin |
| 4,805,784 | A | * | 2/1989 | Solheim et al. ..... 211/94.01 |
| 4,882,868 | A | | 11/1989 | Fast |
| 4,960,028 | A | | 10/1990 | Ramirez |
| 4,987,817 | A | | 1/1991 | Diaz |
| 5,109,993 | A | | 5/1992 | Hutchison |
| 5,165,552 | A | | 11/1992 | Muhlbauer |
| 5,337,646 | A | | 8/1994 | Austin |
| 5,367,939 | A | | 11/1994 | Barker |
| D355,694 | S | | 2/1995 | Stafford, Jr. |
| 5,429,336 | A | * | 7/1995 | Ko ..... 248/278.1 |
| 5,520,292 | A | | 5/1996 | Lombardi |
| 5,756,912 | A | | 5/1998 | Liao |

(Continued)

*Primary Examiner*—Hugh B. Thompson, II
(74) *Attorney, Agent, or Firm*—Holland & Knight LLP

(57) ABSTRACT

Disclosed is a display arm for a musical cymbal. The arm allows cymbals to be presented in a retail environment without interfering with playability. This allows consumers to play the cymbal to determine whether or not it meets their musical needs. The display arm also precludes the theft or unauthorized removal of the cymbal. This is achieved by special screw assemblies which can only be uncoupled by store personnel. A display panel is also provided whereby relevant product literature can be presented to potential purchasers.

7 Claims, 4 Drawing Sheets

U.S. PATENT DOCUMENTS 5,836,561 A 11/1998 Liao
5,897,002 A 4/1999 Carlino
5,934,629 A 8/1999 Peritz
6,054,645 A * 4/2000 Gauger ..... 84/422.3
6,091,008 A 7/2000 Yu
6,093,878 A * 7/2000 Hoshino ..... 84/421
6,177,621 B1 1/2001 Hoshino
6,199,706 B1 3/2001 Shea
6,204,440 B1 3/2001 Yu
6,209,835 B1 * 4/2001 Walrath et al. ..... 248/276.1
6,238,129 B1 5/2001 Rahn
6,239,343 B1 5/2001 Hoshino
6,245,980 B1 6/2001 May
6,274,797 B1 * 8/2001 Liao ..... 84/421
6,293,511 B1 9/2001 Shepherd
6,417,434 B1 7/2002 Lao
6,896,230 B2 * 5/2005 Cvek ..... 248/276.1
7,066,339 B2 * 6/2006 Chiu et al. ..... 211/70.6

* cited by examiner

FIG 7
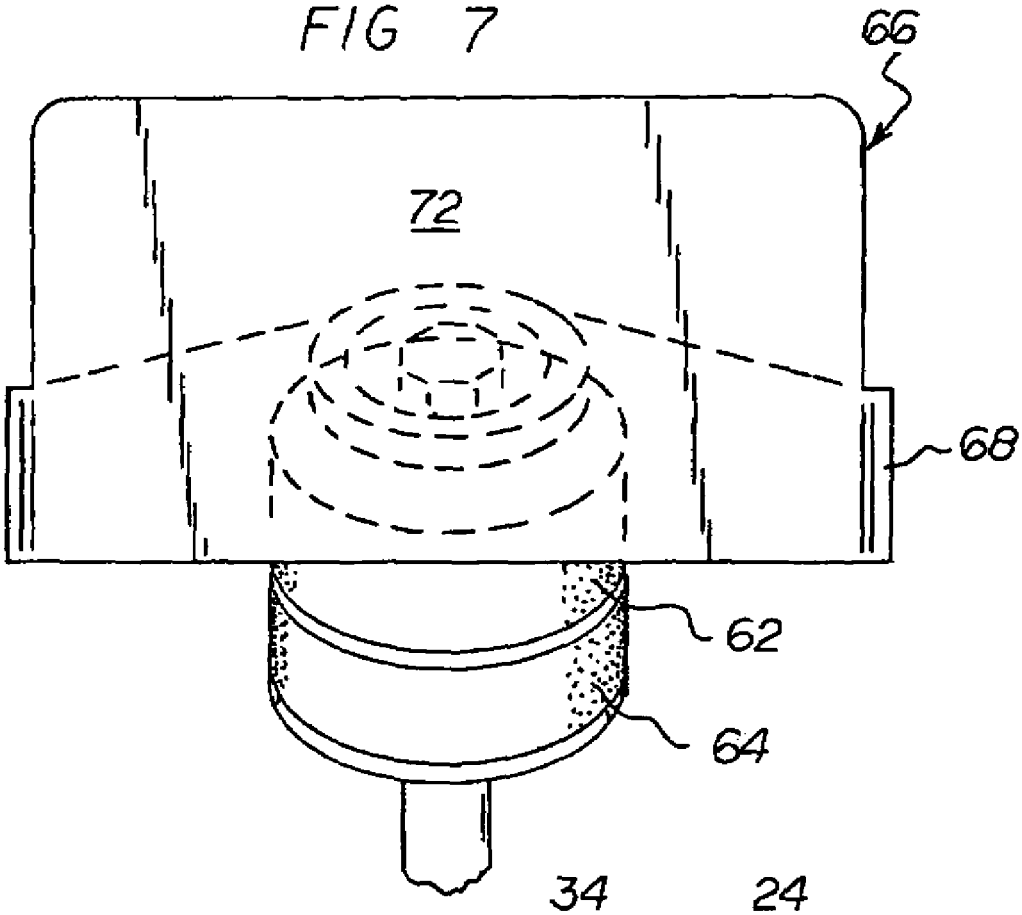
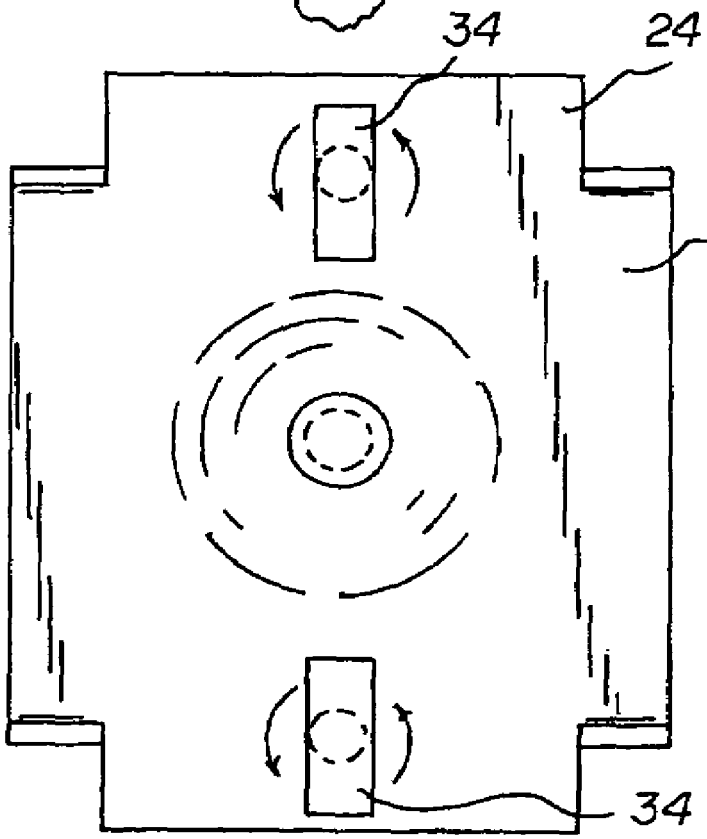
FIG 8

DISPLAY ARM FOR CYMBAL

RELATED APPLICATION DATA

This application is a continuation-in-part of application Ser. No. 10/050,899 filed Jan. 16, 2002, now abandoned and entitled "Display Arm For Cymbal," which application claims priority from provisional application Ser. No. 60/261,992 filed Jan. 16, 2001, entitled "Display Arm for Cymbal." Both of these applications are incorporated herein by reference.

BACKGROUND OF THE INVENTION

1. Field of the Invention

This invention relates to mounting arm for displaying a musical cymbal. More specifically, the present invention relates to a mounting arm which is adjustable and which can display product information.

2. Description of the Background Art

Presently, cymbals are displayed by way of storage racks. An example is illustrated in U.S. Pat. No. 5,165,552 to Muhlbauer. However, the storage racks of Muhlbauer do not retain cymbals in a secure manner and as a consequence the cymbals are subject to theft. Additionally, the racks do not provide any means for displaying product information. Consequently, the storage rack of Muhlbauer does not lend itself to use within a retail environment.

U.S. Pat. No. 6,204,440 to Yu discloses a guitar-holder device with a u-shaped hanger, which can be hung upon a rack. The holder further includes a pivotal u-shaped bar which is adapted to engage a guitar. Again, however, the holder of Yu does not provide any means for theft deterrence and additionally, does not provide any means for the convenient display of product literature.

Yet another musical instrument hanger is disclosed in U.S. Pat. No. 4,182,505 to Cobin. The hanger of Cobin is adapted to be hung from a wall. The holder of Cobin is similar to the holder of Yu in that it does not provide any theft deterrence or any means for product identification.

Finally, U.S. Pat. No. 6,245,980 to May discloses a cymbal display and a performance support. The display includes a clamp with a slotted portion for receiving a display card indicating size, model number and/or price. Although May provides for product identification, it does not disclose an integrated display stand and product support. Rather, the device of May is an after market device for use in conjunction with existing displays. Furthermore, May does not disclose an effective theft deterrent construction.

Thus, although each of the above-referenced inventions achieves their individual objectives, they all suffer from similar drawbacks. That is, none of the above-described display devices supports a musical cymbal in a theft deterrent manner. Moreover, none of the above-referenced inventions provides a means for the convenient display of product literature, while at the same time preventing theft of the instrument being displayed. For these reasons, none of these inventions lends itself for use within a retail environment.

SUMMARY OF THE INVENTION

It is therefore one of the objectives of this invention to provide a display for a musical instrument that can secure the instrument in a retail environment.

It is also an object of this invention to display a musical instrument in a manner that allows customers to play the instrument but at the same time deters theft.

Still another object of this invention is to provide a musical instrument display which has an integrated product identification system whereby customers can readily see relevant product literature.

These and other objectives are carried out by an apparatus for displaying a musical cymbal and associated product literature upon a slat wall. The apparatus includes base plate with upper and lower surfaces and a series of bent mounting strips. The mounting strips are adapted to be inserted within a slat wall for supporting the apparatus. A pair of rotatable lock bars are pivotally mounted to the lower surface of the base plate, with each of the lock bars being controlled by an interconnected screw assembly mounted through the base plate. Each screw assembly has an upper user accessible end surrounded by a raised peripheral edge.

A first arm is also included and has a distal end and a proximal end, with the proximal end rigidly interconnected to the upper surface of the base plate. The second arm likewise has a distal end and a proximal end, with the proximal end pivotally interconnected to the distal end of the first arm by way of a tilter mechanism. The tilter mechanism includes two opposed geared faces that can be indexed relative to one another to change the angle between the first and second arms. A spring is associated with the tilter mechanism and serves to bias the faces towards one another.

Upper and lower felts are interconnected to the distal end of the second arm and are employed in removably securing a cymbal. A display assembly is interconnected to the upper felt, with the display assembly having a u-shaped base portion and an interconnected panel. The panel is adapted to receive the associated product literature. A screw assembly extends through the u-shaped base portion and is interconnected to distal end of the second arm. The screw assembly serves to secure the display assembly to the cymbal and the upper and lower felts. The screw assembly has an upper user accessible end surrounded by a raised peripheral edge.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 7 is an end view of the display assembly taken along line 7—7 of FIG. 6.

FIG. 8 is an end view of the base plate taken long line 8—8 of FIG. 2.

Similar reference characters refer to similar parts throughout the several views of the drawings.

DETAILED DESCRIPTION OF THE PREFERRED EMBODIMENT

The present invention relates to a display arm for a musical cymbal. The arm allows cymbals to be presented in a retail environment without interfering with playability. This allows consumers to play the cymbal to determine whether or not it meets their musical needs. The display arm also precludes the theft or unauthorized removal of the cymbal. This is achieved by special screw assemblies which can only be uncoupled by store personnel. A display panel is also provided whereby relevant product literature can be presented to potential purchasers. These various features of the present invention are described in greater detail hereinafter.

Figure 1:
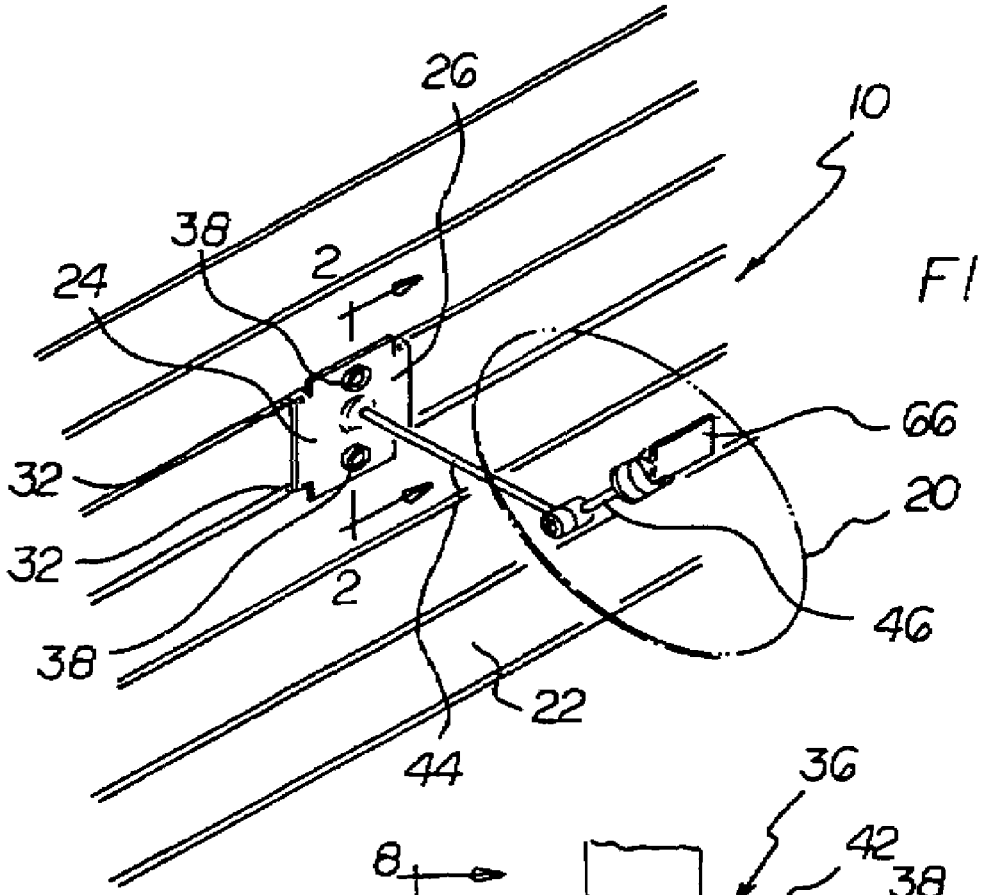
FIG. 1 is a perspective view of the display arm in use upon a slatwall.

With reference now to FIG. 1, the display arm assembly 10 of the present invention is illustrated in position upon a conventional slatwall 22. As illustrated, the assembly 10 supports a cymbal 20 upon the slatwall 22. Slatwalls are known in the art and are found in various retail environments including music stores. Slatwalls enable products to be conveniently secured at various horizontal and vertical positions along the wall. Thus, products can be easily positioned for access by customers. As can be appreciated from FIGS. 1 and 2, the wall 22 includes a series of horizontally oriented slots, each of which is adapted to receive a display device. The slots permit access to a space located behind the wall.

With continuing reference to FIG. 1, the base plate 24 of the present invention is depicted. This plate 24 is defined by upper and lower surfaces (26 and 28) and in the preferred embodiment is rectangular in shape. A series of mounting strips 32 are formed within each of the four corners of the plate 24. Preferably, these mounting strips 32 are formed by bending the corners of the plate 24 to a position perpendicular to the lower surface 28. Consequently, the strips 32 have a thickness equal to the thickness of the base plate 24 and have an orientation permitting their insertion into the channels of the slatwall 22. With the mounting strips 32 positioned within the slatwall 22, the remainder of the apparatus 10 can be supported in a cantilevered fashion.

The base plate 24 additionally includes lock bars 34, which function to secure the apparatus 10 to the slatwall 22. In the preferred embodiment, two rotatable lock bars 34 are pivotally mounted to the lower surface 28 of the base plate 24. Yet, the use of other numbers of lock bars is within the scope of the present invention. Each lock bar 34 is controlled by an interconnected screw assembly 36 that extends through the base plate 24 (note FIG. 2). Each screw assembly 36 has a lower end to which the lock bar 34 is secured and an upper end 38 that is accessible by a user from the upper surface 26 of the base place 24. A spring can also be employed within the screw assembly.

Thus, in operation, the screws 36 can be rotated to position the lock bars 34 into alignment with the slats of the wall 22, as well as the adjacent mounting strips 32. With the bars 32 so oriented, the base plate 24 can be positioned into the slatwall 22. This is accomplished by inserting the mounting strips 32 and lock bars 32 into adjacent channels on the slatwall 22. This places the entire apparatus 10 in a cantilevered position relative to the wall 22. Thereafter, the screw assemblies 36 are rotated 90 degrees to thereby rotate the lock bars 90 degrees. This places the lock bars 34 in a position perpendicular to the channels of the slatwall 22. This has the effect of locking the base plate 24 against the slatwall 22. Theft deterrence is provided by the configuration of the upper end 38 of each screw assembly 36. Namely, the upper end 38 is surrounded by a raised peripheral edge 42. This insures that the screw can only be rotated by way of a specialized wrench, or key, which is maintained by the store personnel. In this manner, customers are prevented from removing the entire display (and cymbal) from the slatwall 22.

Figure 2:
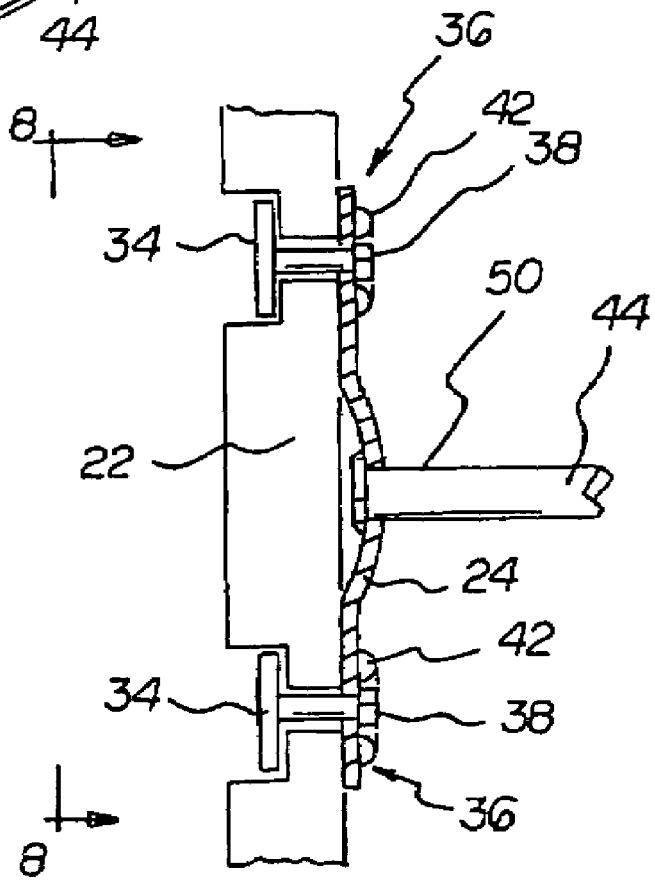
FIG. 2 is a detailed sectional view of the base plate taken along line 2—2 of FIG. 1.
Figure 3:
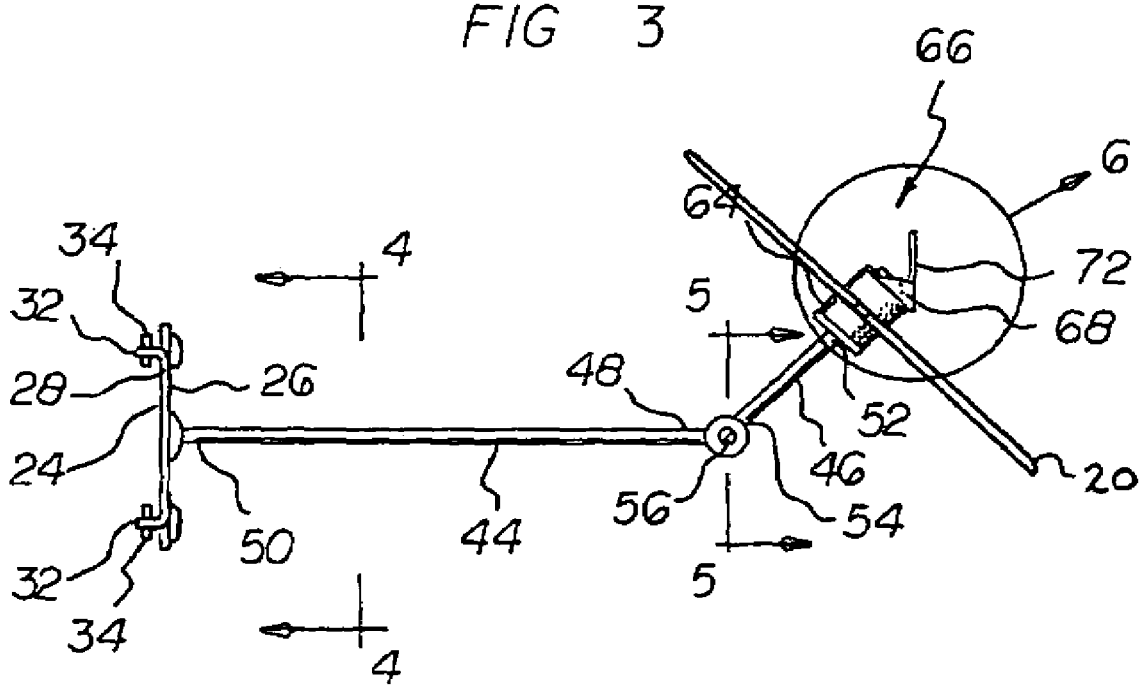
FIG. 3 is a side view of the display assembly of the present invention.
Figure 4:
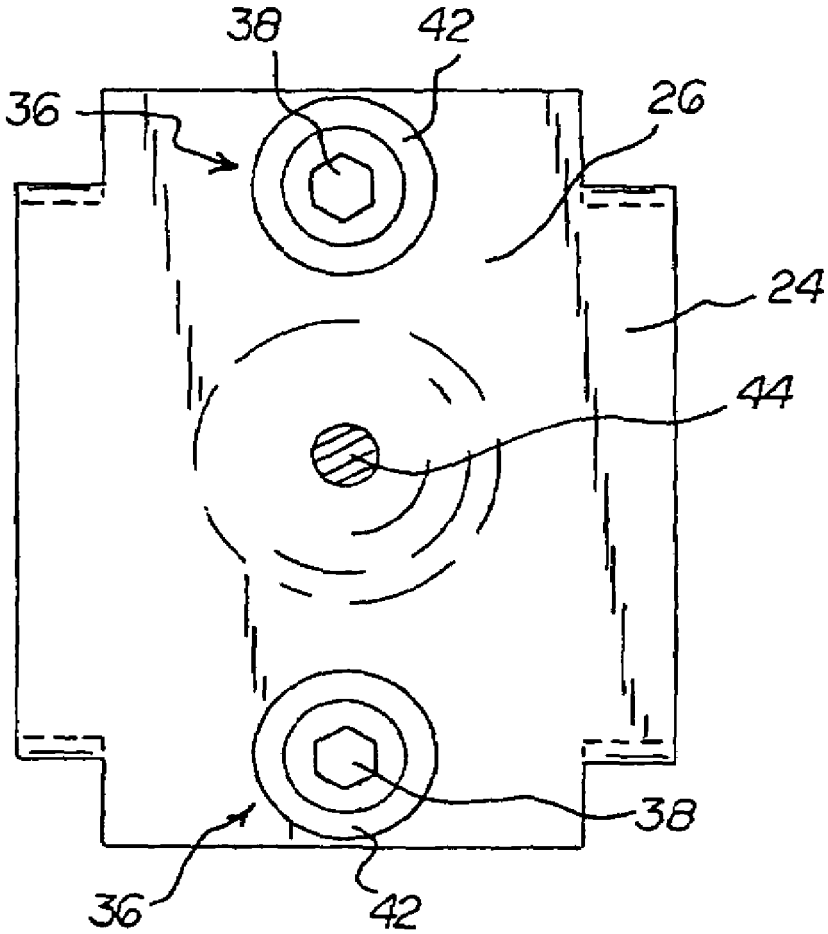
FIG. 4 is a detailed view of the screw assemblies of the base plate taken along line 4—4 of FIG. 3.

The display apparatus 10 further includes first and second arms (44 and 46). Although the use of two arm components is preferred the use of other numbers of arms is within the scope of the present invention. With reference to FIG. 3, the first arm 44 is illustrated as having a proximal end 50, which is rigidly interconnected to the upper surface 26 of the base plate 24 and an opposed distal end 48. The interconnection between the first arm 44 and the base plate 24 is depicted in FIGS. 2 and 4. The second arm 46 likewise has both a distal 52 and a proximal end 54, with the proximal end 54 of the second arm 46 being pivotally interconnected to the distal end 48 of the first arm 44.

In the preferred embodiment, the first and second arms (44 and 46) are pivotally interconnected and articulated by way of a tilter mechanism 56. The tilter mechanism 56, depicted in FIG. 5, includes two hubs with opposed geared faces 58. These geared faces 58 permit the two hubs to be interconnected at any number of discreet angular positions. This indexing of the geared faces 58 enables the angle between the first and second arms 44 and 46 to be adjusted. The two hubs are further interconnected by way of a central axle and a threaded bolt. Other means of interconnecting the two arms 44 and 46 are also within the scope of the present invention. For example, the two arms 44 and 46 can be interconnected by the screw assembly 36 described above in conjunction with the base plate 24. Such a screw assembly would further add to the theft resistant nature of the device.

Figure 5:
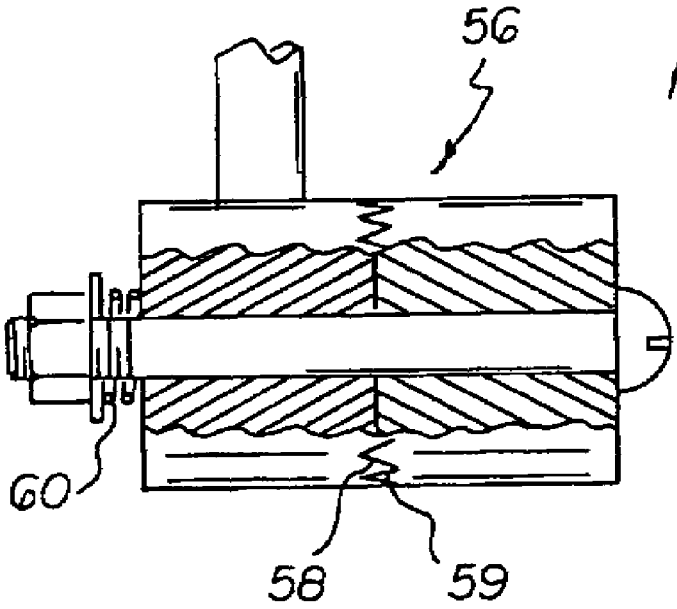
FIG. 5 is a sectional view of the tilter mechanism as taken along line 5—5 of FIG. 3.

With reference now to FIG. 5, a spring 60 is employed within the tilter mechanism 56 along the length of the axle. This spring 60 serves to bias the geared faces 58 towards one another. Thus, when a user wishes to adjust the angle between the two arms 44 and 46, the faces of the tilter mechanism 56 can be pulled apart by overcoming the spring tension. Thereafter, the arms 44 and 46 can be moved to the desired angular orientation. After the correct positioning is achieved, the faces 58 are permitted to re-engage with the assistance of the spring force. Once the faces are engaged, the spring force and geared faces 58 act to keep the arms in the desired orientation.

In the preferred embodiment, the display arm is employed in supporting a cymbal 20. However, the arm can be adapted to support other instruments, such as guitars, violins, or saxophones. In the preferred embodiment, the cymbal 20 is positioned at the distal end 52 of the second arm 46 intermediate upper and lower felts (62 and 64). These felts (62 and 64) are constructed from a soft cloth material and enable the cymbal 20 to be displayed without a reduction in any sound quality while playing. The felts (62 and 64) include central apertures that allow them to be positioned over the distal end 52 of the second arm 46. The felts are retained upon the arm by way of a screw assembly 76 in a manner more fully described hereinafter. Finally, other materials can be employed to support the cymbal 20. For instance, rubber grommets can be used above and below the cymbal 20 to provide an acceptable level of sound quality.

Figure 6:
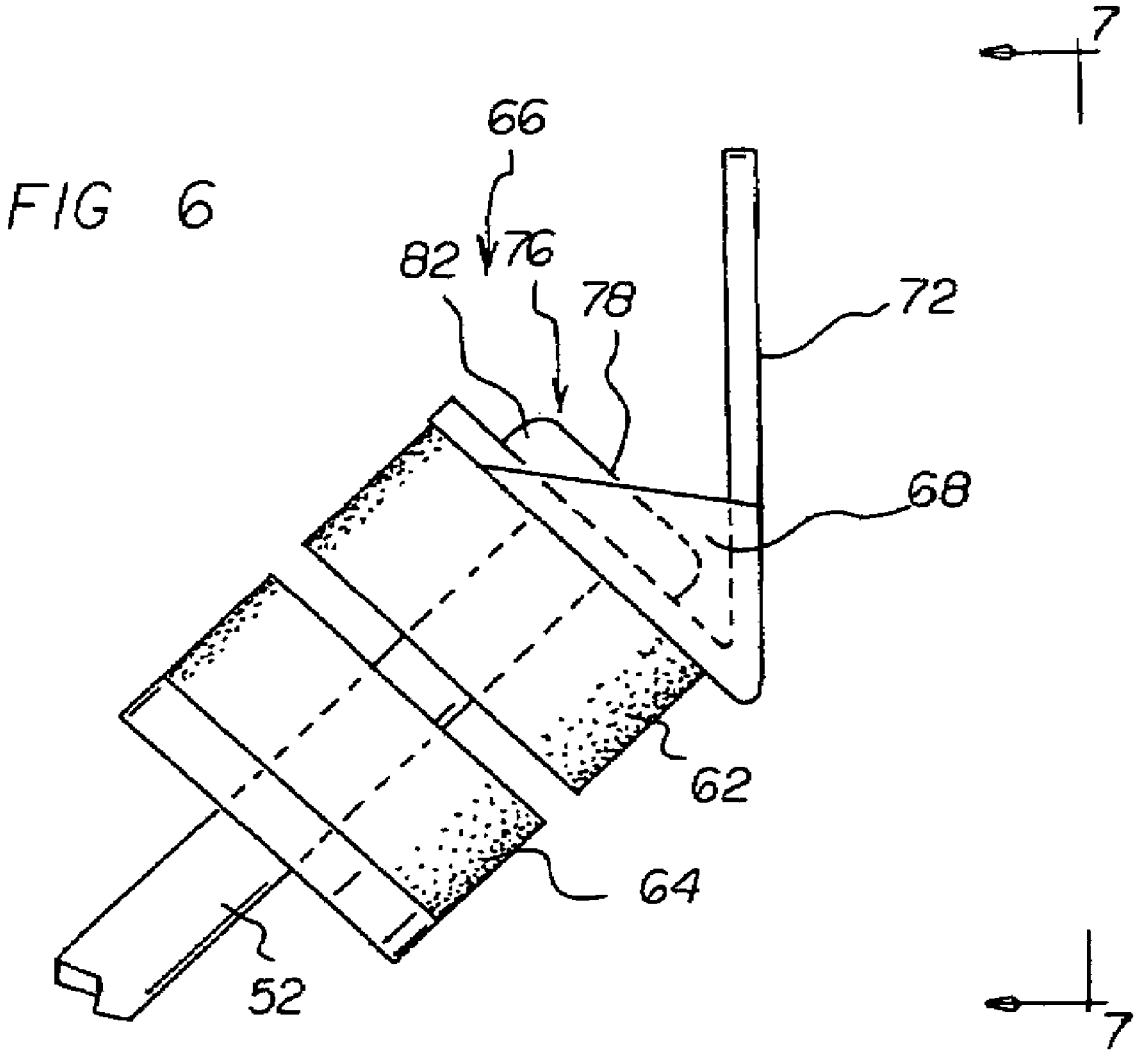
FIG. 6 is a detailed view of the display assembly taken from FIG. 3.

The display assembly 66 is depicted in FIGS. 6 and 7. The assembly 66 has a u-shaped base portion 68 to which a panel 72 is interconnected. The interconnection can be rigid or pivotal to permit the angular adjustment of the panel 72. The panel 72 is adapted to receive associated product literature. The product literature can be secured to the panel in a wide variety of ways. For example, the product literature can be inserted within opposed channels formed upon the panel 72, or the product literature may be adhered to the panel surface by way of an adhesive or the like. The material displayed can relate to pricing or may contain generalized product information, such as make and model number.

The display assembly 66 is retained upon the distal end 52 of the second arm 46. The preferred screw assembly 76 is identical to the screw assembly 36 described in conjunction with the base plate 24. Such an assembly 76 has an upper end 78 that is accessible by a user from the upper surface of the base portion 68. Again, as described, the upper end 78 includes a raised peripheral edge 82 such that the display and upper felt 62 can only be removed by way of a specialized wrench or key. Once secured, the screw assembly 76 in secured through the U-shaped base plate 68 of the display assembly 66 and is received within the distal end 52 of the second arm 46. The assembly 76 is employed in interconnecting the display assembly 66 to the upper felt 62 and prevents removal of the felts (62 and 64) or cymbal 20 from the arm.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. An apparatus for displaying a musical cymbal and associated product literature upon a slat wall, the apparatus comprising:

a base plate with upper and lower surfaces and a series of bent mounting strips, the mounting strips adapted to be inserted within a slat wall for supporting the apparatus;

a pair of rotatable lock bars pivotally mounted to the lower surface of the base plate, each of the lock bars being controlled by an interconnected screw assembly mounted through the base plate, each screw assembly having an upper user accessible end surrounded by a raised peripheral edge;

a first arm having a distal end and a proximal end, the proximal end rigidly interconnected to the upper surface of the base plate;

a second arm having a distal end and a proximal end, the proximal end pivotally interconnected to the distal end of the first arm by way of a tilter mechanism, the tilter mechanism including two opposed geared faces which can be indexed relative to one another to change the angle between the first and second arms, a spring associated with the tilter mechanism and serving to bias the faces towards one another;

upper and lower felts interconnected to the distal end of the second arm, the upper and lower felts functioning to removably secure the musical cymbal;

a display assembly interconnected to the upper felt, the display assembly having a base portion and an interconnected panel, the panel being adapted to receive the associated product literature;

a screw assembly extending through the base portion and interconnected to distal end of the second arm, and screw assembly serving to secure the display assembly, the cymbal and the upper and lower felts, the screw assembly having an upper user accessible end surrounded by a raised peripheral edge.

2. An apparatus for displaying a cymbal comprising:

a base plate cantilevered within a wall for supporting the apparatus;

a first arm having a distal end and a proximal end, the proximal end interconnected to the base plate;

a second arm having a distal end and a proximal end, the proximal end pivotally interconnected to the distal end of the first arm, the distal end of the second arm including upper and lower felts that function in retaining the cymbal;

a display-assembly interconnected to the upper felt, the display assembly having a base portion and a panel, wherein the panel is adapted to receive associated product literature;

a lock bar pivotally mounted to the base plate, the lock bar being positioned behind the wall and having a first orientation permitting the base plate to be removed from the wall, and a second orientation wherein the base plate is locked upon the wall.

3. The apparatus as described in claim 2 wherein the first and second arms are interconnected by way of a tilter mechanism, the tilter mechanism including two opposed geared faces which can be indexed relative to one another to change the angle between the first and second arms.

4. The apparatus as described in claim 3 further comprising a spring associated with the tilter mechanism which serves to bias the faces of the tilter mechanism towards one another.

5. The apparatus as described in claim 2 further comprising an interconnected screw assembly mounted through the base plate that serves to control the lock bar, with the screw assembly having an upper user accessible end surrounded by a raised peripheral edge.

6. A system for supporting a musical instrument and associated product literature within a retail store comprising:

a slat wall;

an arm having a first end adapted to be removably interconnected to the slat wall and a second end with upper and lower felts for use in securing the musical instrument;

a display assembly interconnected to the upper felt of the arm, the display assembly including a base portion and a panel adapted to receive product literature;

a lock bar interconnected to the end of the arm and functioning to selectively lock the arm to the slat wall.

7. The apparatus as described in claim 6 wherein the arm is articulated.

* * * * *